US005954253A

United States Patent [19]

Swetish

[11] Patent Number: 5,954,253

[45] **Date of Patent: *Sep. 21, 1999**

[54] FLEXIBLE FRAME LOAD CARRYING SYSTEM

[75] Inventor: Thomas R. Swetish, Kenosha, Wis.

[73] Assignee: Johnson Worldwide Associates, Inc., Sturtevant, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/673,742

[22] Filed: Jun. 26, 1996

[51] Int. Cl.[6] ..... A45F 3/08; A45F 3/10; A45F 3/12

[52] U.S. Cl. ..... 224/631; 224/628; 224/637; 224/638; 224/643; 224/644; 224/934

[58] Field of Search ..... 224/153, 620, 224/630, 631, 633, 634, 635, 636, 637, 638, 639, 627, 645, 642, 643, 644, 261, 262, 263, 934

[56] References Cited

U.S. PATENT DOCUMENTS

| | | | |
|---|---|---|---|
| 385,429 | 7/1888 | Sohner . | |
| 1,150,664 | 8/1915 | Cramer . | |
| 1,879,480 | 9/1932 | Pures . | |
| 2,008,201 | 7/1935 | Chute . | |
| 2,760,699 | 8/1956 | Rivers-McPherson . | |
| 2,925,205 | 2/1960 | Hunt . | |
| 3,114,486 | 12/1963 | Flexman | 224/628 |
| 3,355,075 | 11/1967 | Dean . | |
| 3,442,427 | 5/1969 | Arnell et al. . | |
| 3,831,827 | 8/1974 | Olson . | |
| 3,889,859 | 6/1975 | Joseph . | |
| 3,899,109 | 8/1975 | Noice . | |

(List continued on next page.)

FOREIGN PATENT DOCUMENTS

| | | | |
|---|---|---|---|
| 597307 | 5/1990 | Australia . | |
| 1044197 | 12/1978 | Canada . | |
| 1124693 | 6/1982 | Canada . | |
| 273087 | 7/1988 | European Pat. Off. | 224/213 |
| 0 692 206A1 | 6/1995 | European Pat. Off. . | |
| 2586539 | 3/1987 | France . | |
| 2 630 897 | 11/1989 | France . | |
| 2660173 | 3/1990 | France . | |
| 2677235 | 12/1992 | France . | |
| WO92/21265 | 12/1992 | France . | |
| 2754061 | 6/1979 | Germany . | |
| 3918346 | 12/1990 | Germany . | |
| 9211361 | 12/1992 | Germany . | |
| 335 811 | 3/1959 | Switzerland . | |
| 2 223 930 | 4/1990 | United Kingdom . | |

OTHER PUBLICATIONS

*The New York Times* — "Outdoor Equipment Designers Reset Their Sights on Fanatics" May 5, 1991.

*Primary Examiner*—Linda J. Sholl
*Attorney, Agent, or Firm*—Foley & Lardner

[57] ABSTRACT

A load support system is provided including a flexible frame unit attached to a shoulder support structure and to a hip belt assembly. The frame is pivotally attached to the hip belt assembly and is held in a slightly bowed configuration, whereby load is transferred from the frame to the hip belt through pivot points and a venting space is created between the frame and a user's back. The shoulder support structure preferably includes a pair of independently positionable shoulder straps that are removably attached to the frame. The hip belt assembly preferably includes a load support belt that may be coupled to the frame, and a hip pad coupled to the load support belt via a hook and loop fastening system. The suspension system may be used to support backpacks, and the like, or may be adapted for other applications including SCUBA tank support. The suspension system may be adjusted independently of the load and affords considerable freedom of movement when worn, due particularly to the pivotal attachment of the hip belt assembly to the frame and to the form of the flexible frame.

35 Claims, 13 Drawing Sheets

U.S. PATENT DOCUMENTS

| | | | |
|---|---|---|---|
| 3,938,718 | 2/1976 | Madison . | |
| 4,015,759 | 4/1977 | Dreissigacker et al. . | |
| 4,049,164 | 9/1977 | Sullivan et al. . | |
| 4,099,657 | 7/1978 | Zufich . | |
| 4,114,788 | 9/1978 | Zufich | 224/634 |
| 4,135,654 | 1/1979 | Chu . | |
| 4,194,656 | 3/1980 | Zufich . | |
| 4,214,685 | 7/1980 | Pletz . | |
| 4,217,998 | 8/1980 | Alexander . | |
| 4,298,149 | 11/1981 | Gottschalk et al. . | |
| 4,303,186 | 12/1981 | Ollinger . | |
| 4,307,826 | 12/1981 | Stewart . | |
| 4,318,502 | 3/1982 | Lowe et al. . | |
| 4,361,259 | 11/1982 | Chanter . | |
| 4,369,903 | 1/1983 | Wilkes . | |
| 4,420,103 | 12/1983 | Douglass . | |
| 4,438,763 | 3/1984 | Zablen . | |
| 4,558,808 | 12/1985 | Fullmer . | |
| 4,676,418 | 6/1987 | Lowe . | |
| 4,715,293 | 12/1987 | Cobbs . | |
| 4,750,654 | 6/1988 | Menetrier . | |
| 4,830,245 | 5/1989 | Arakaki . | |
| 4,842,173 | 6/1989 | Scherer . | |
| 4,884,731 | 12/1989 | Sibley . | |
| 4,911,346 | 3/1990 | Shallman . | |
| 5,004,135 | 4/1991 | Dufournet et al. . | |
| 5,038,984 | 8/1991 | Izzo | 224/644 |
| 5,114,059 | 5/1992 | Thatcher . | |
| 5,181,638 | 1/1993 | McHale . | |
| 5,184,764 | 2/1993 | Orovan et al. . | |
| 5,240,159 | 8/1993 | Gregory . | |
| 5,284,279 | 2/1994 | Sason et al. . | |
| 5,361,955 | 11/1994 | Gregory | 224/630 |
| 5,366,126 | 11/1994 | Dausien . | |
| 5,464,136 | 11/1995 | Eddy . | |
| 5,503,314 | 4/1996 | Fiscus . | |
| 5,553,759 | 9/1996 | McMaster et al. . | |

FIG. 3
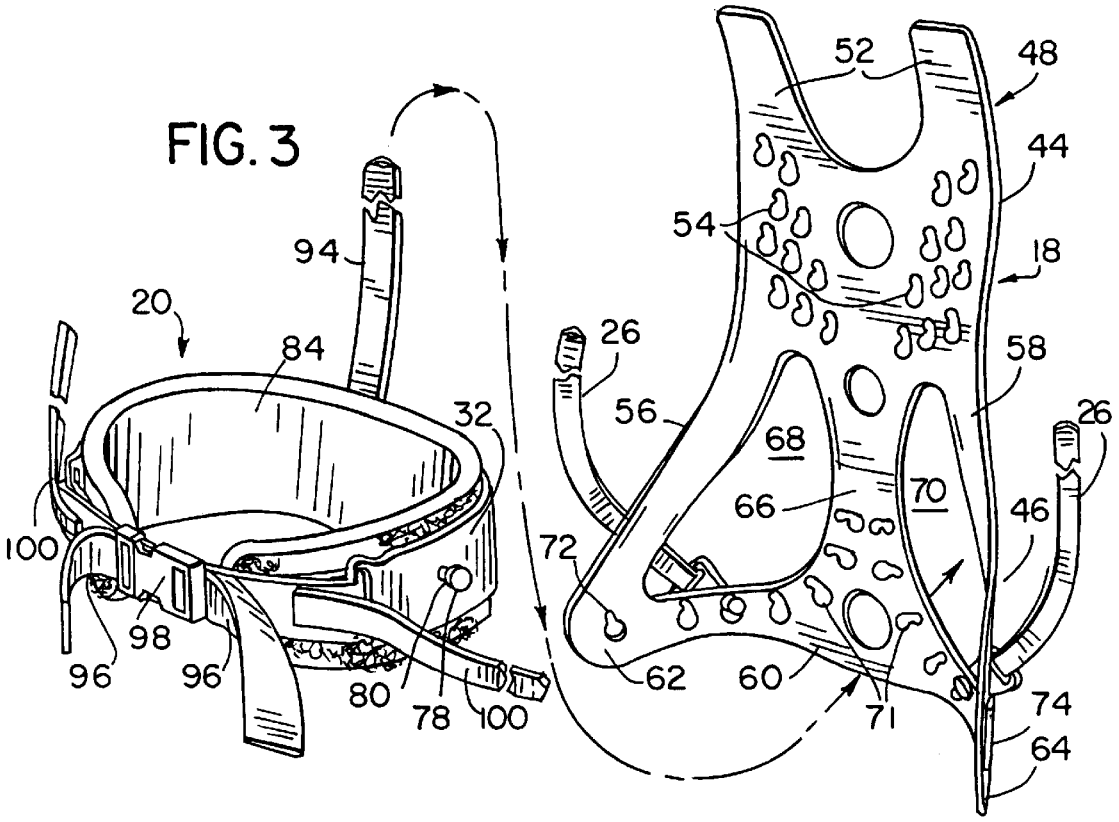
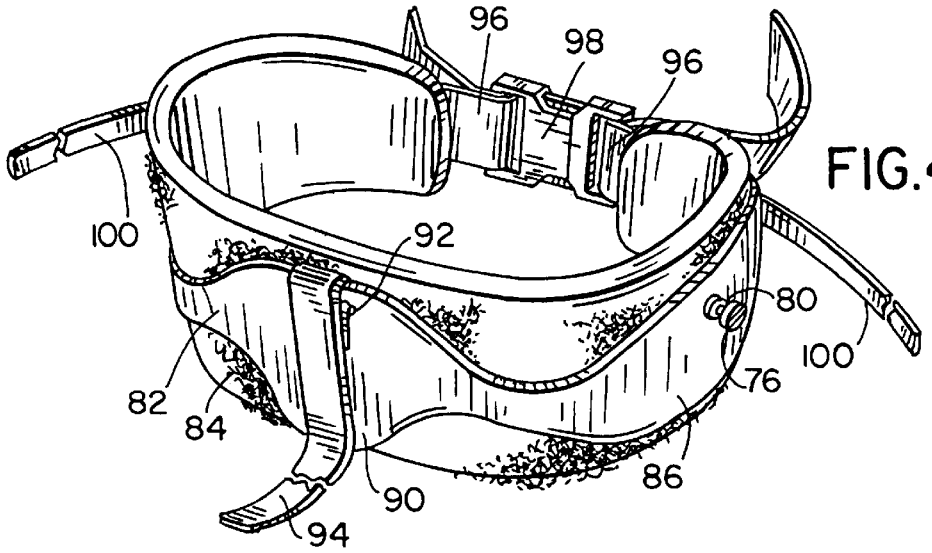
FIG. 4

FIG. 8
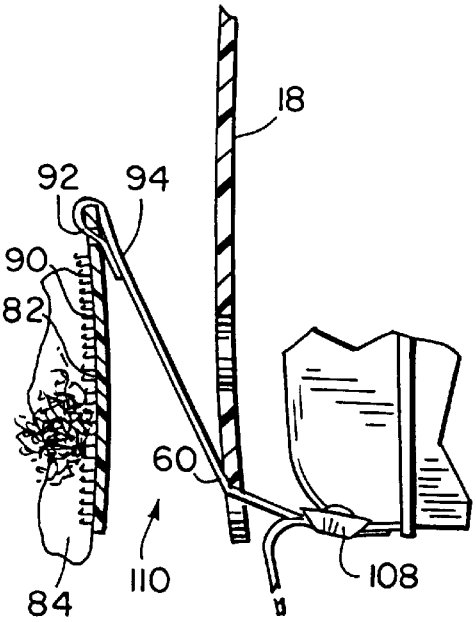
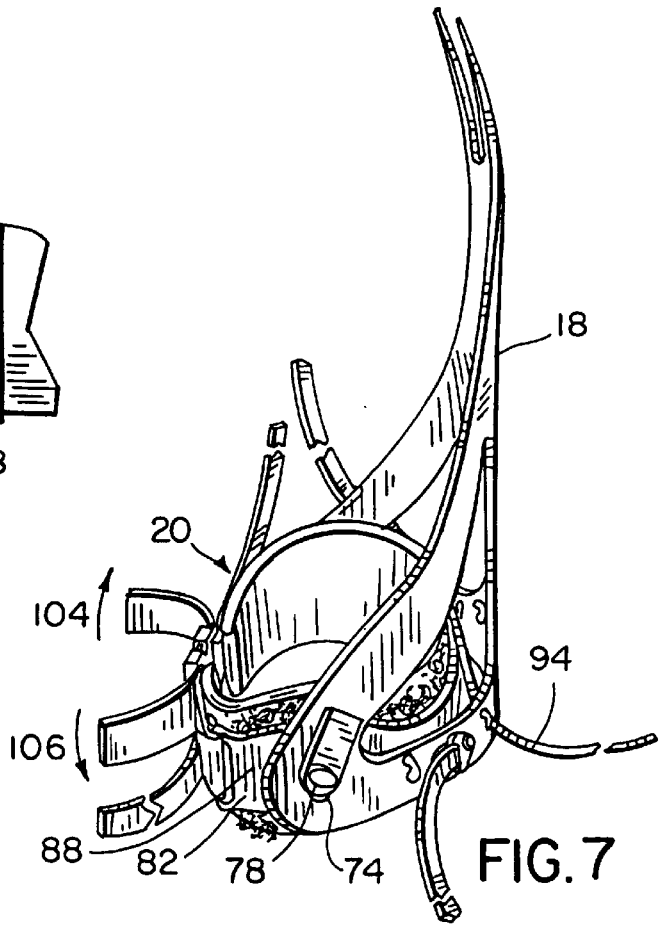
FIG. 7
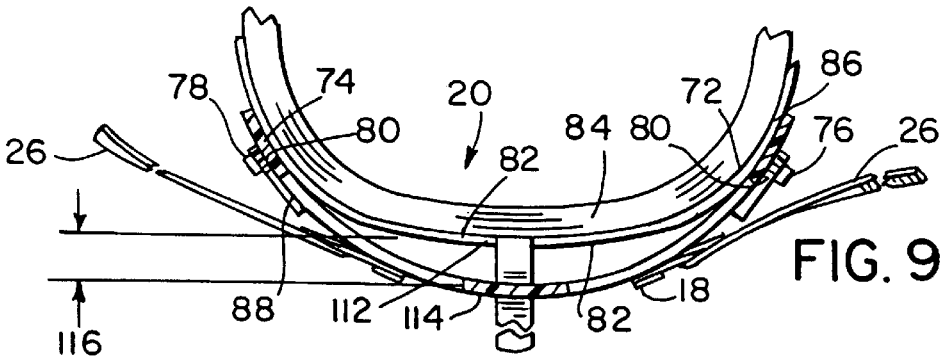
FIG. 9

FIG. 10
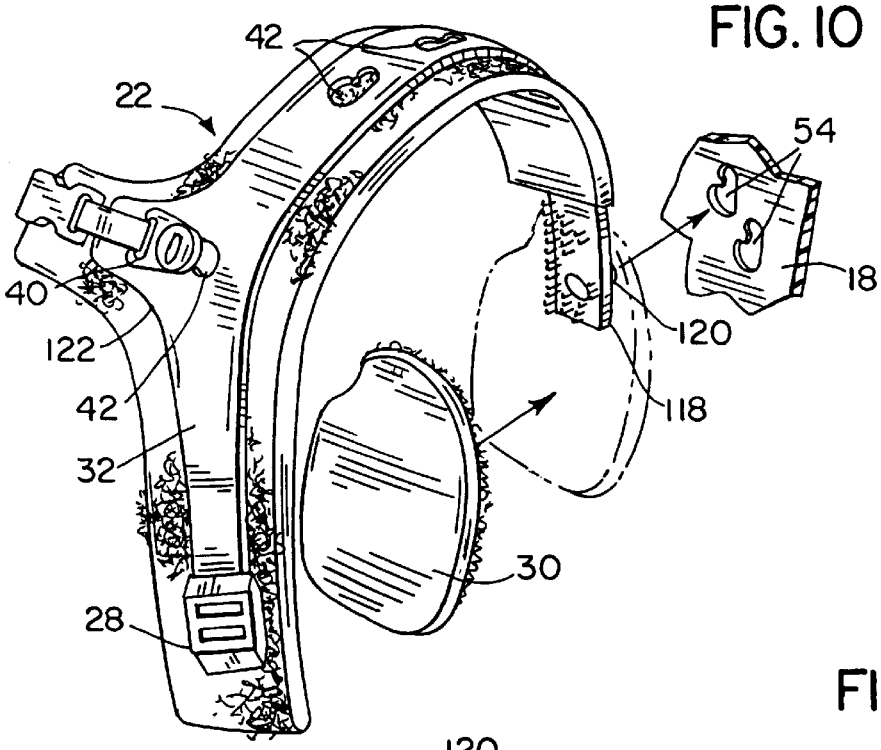
FIG. 11
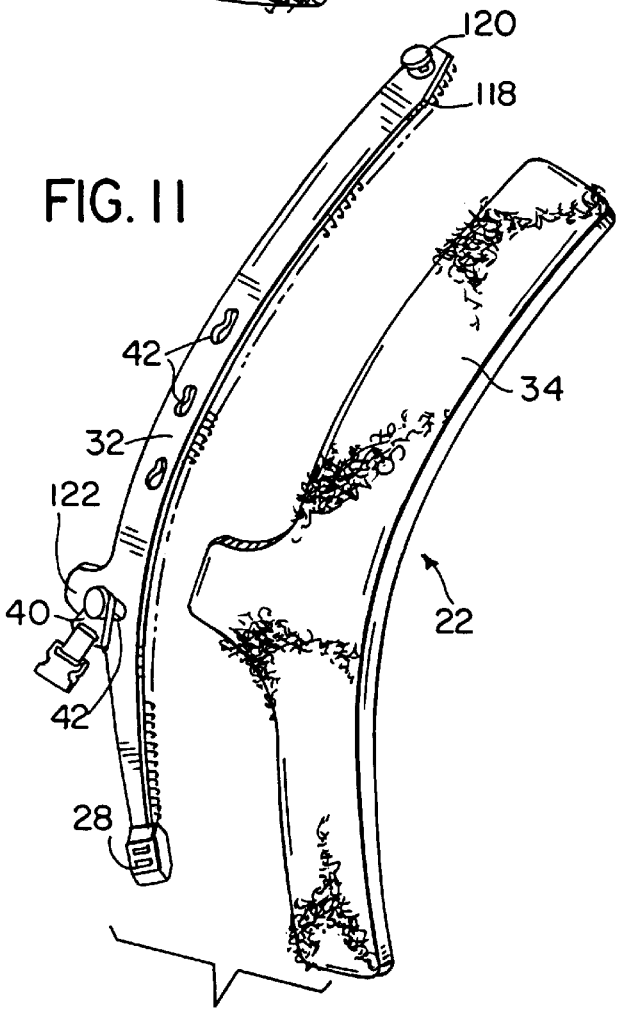
FIG. 12
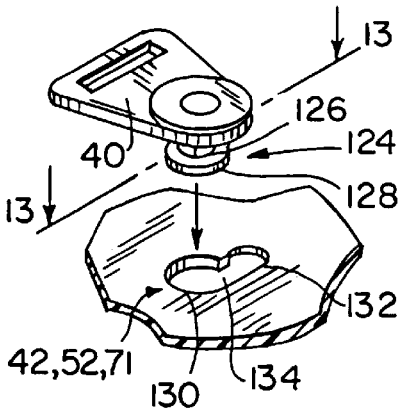
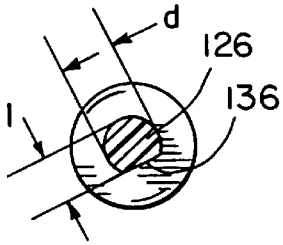
FIG. 13

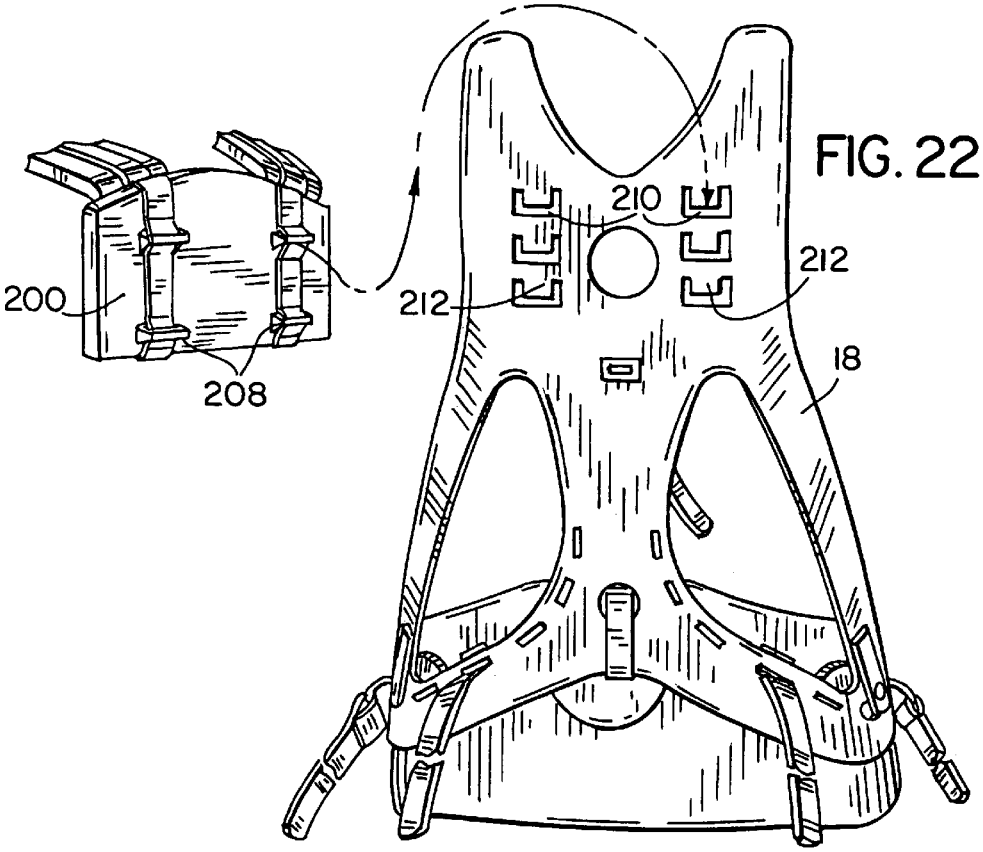
FIG. 22
FIG. 23
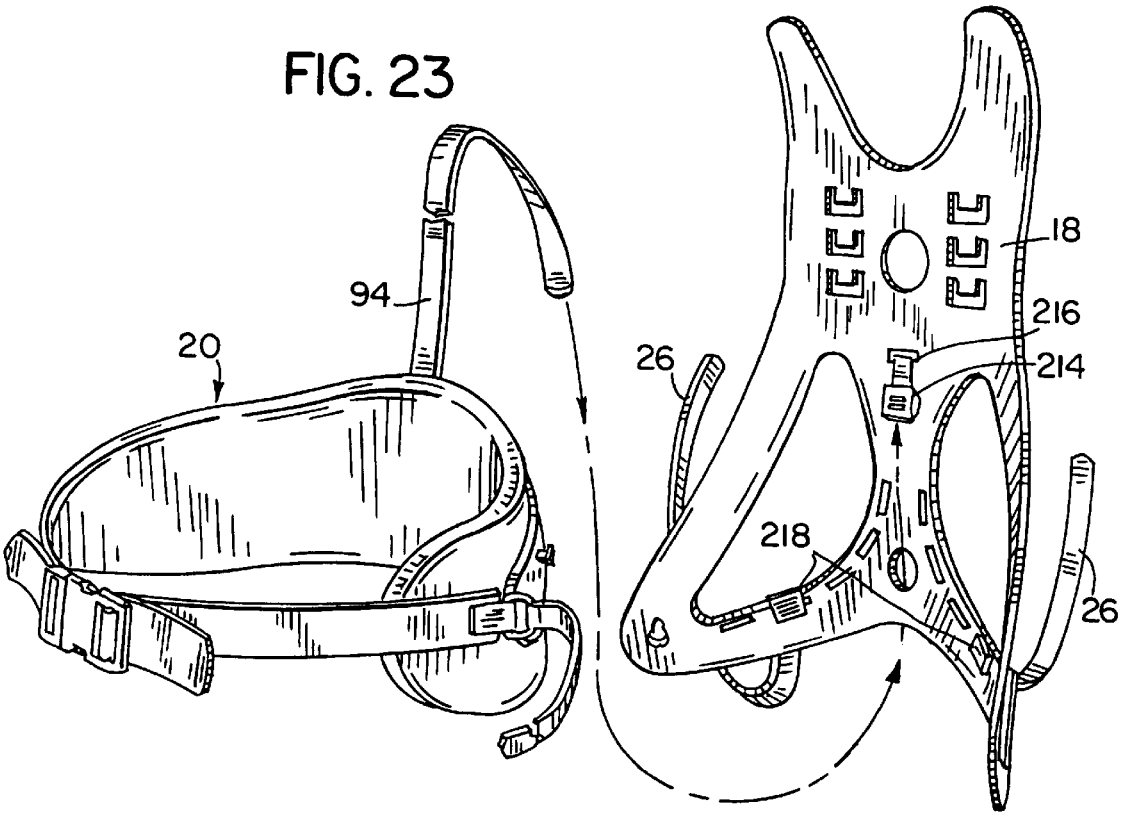

FLEXIBLE FRAME LOAD CARRYING SYSTEM

BACKGROUND OF THE INVENTION

The present invention relates generally to a load carrying system for supporting and transporting loads on a user's back. More particularly, the invention relates to a system for comfortably supporting a load, such as a backpack, buoyancy compensator or the like, on a user's back and hips, providing adequate support for the load while affording the user considerable freedom of movement.

Conventional backpacks and similar structures for supporting and carrying a load on a user's back typically include a load carrying compartment and shoulder straps allowing the user to hold the load. Small capacity packs often require no other support structure for comfortably supporting the load. However, larger capacity packs and carrying structures, such as buoyancy compensators for divers, often include a rigid internal or external frame structure designed to lend additional support to the load and to distribute the load properly on the user's back and hips. As the capacity of the pack and the corresponding weight of the load increases, it is generally advantageous to transfer as much of the load as possible to the user's hips, thereby removing strain from the back which, over time, may lead to fatigue and pain in the muscle and joints of the back.

Conventional internal and external frames, while providing some degree of support and load distribution, suffer from several drawbacks. For example, such frame structures often do not space the pack load from the user's back, trapping perspiration between the pack and the user's back. Efforts to create an air space for comfortably venting such perspiration have been of limited success. Moreover, rigid pack frames often severely limit the user's freedom of movement, resulting in a somewhat clumsy structure that can be unwieldy when performing sports such as trekking, climbing, skiing and the like.

There is a need, therefore, for an improved load support structure that can be incorporated into backpacks, buoyancy compensators and the like, that offers effective load support while permitting the user to transfer a considerable portion of the load from the shoulders to the hips. Such a structure would advantageously also create an air or venting space between the user's back and the load to allow the user to carry a load over an extended period with less discomfort due to perspiration. In addition, there is a need for an improved support structure that allows the user considerable freedom of movement.

SUMMARY OF THE INVENTION

The invention features a novel load support system designed to respond to these needs. In particular, the invention provides a load support structure including a suspension system with an innovative arrangement for transferring weight from a back support to a hip belt. The support structure creates a venting space between the user's back and the back of the pack, reducing direct contact therebetween. Attachment between the back support and the hip belt preferably includes pivotal connections allowing the hip belt to swing or pivot with respect to the back support and thereby to accommodate the user's bending about the abdomen or waist. The back support structure also preferably includes a flexible support frame that orients and supports the pack load but that may be readily deformed during use, affording the user additional freedom of movement, such as for twisting about the waist and torso.

Thus, in accordance with one aspect of the invention, a system is provided for supporting a load on a user's back and hips, such as in a backpack, buoyancy compensator or the like. The system includes a back support and a hip support. The back support includes a frame and shoulder straps. The frame is coupled to the load and extends over a back region and around hip regions to lower lateral attachment points. The shoulder straps are coupled to the frame for supporting the load on the user's shoulders. The hip support is adapted to be securely supported on the user's hips. The hip support includes a pair of lateral attachment supports, each of the lateral attachment supports of the hip support receiving and cooperating with a lateral attachment point of the frame to pivotally support the frame on the hip support. The hip support thereby provides flexible support for the load through the attachment points of the frame and the lateral attachment supports.

In accordance with another aspect of the invention, a system for supporting a load on a user's back and hips includes a back support and a hip support coupled to one another to form a venting space or region therebetween. The back support includes a flexible frame and shoulder straps, the frame being coupled to the load and extending over a back region and around hip regions to lower lateral attachment points, and the shoulder straps being coupled to the frame for supporting the load on the user's shoulders. The hip support is adapted to be securely supported on the user's hips. The hip support includes a pair of lateral attachment supports, each of the lateral attachment supports of the hip support cooperating with a lateral attachment point of the frame to support the frame on the hip support. The attachment supports are spaced from one another by a first distance and the attachment points being spaced from one another by a second distance greater than the first distance. Attachment of the frame on the hip support thereby retains the frame in a deformed configuration creating a venting space between the hip support and the frame.

In accordance with a further aspect of the invention, a frame is provided for a load support system. The load support system is of the type generally found in backpacks, buoyancy compensators, and similar structures, including a load carrying structure, shoulder straps for supporting the load carrying structure on a user's shoulders, and a hip support for supporting the load carrying structure on the user's hips. The frame includes a flexible panel of deformable plastic material having left and right lateral struts extending at an angle from an upper region of the frame to left and right lower corners, respectively. Left and right attachment points are located at the left and right lower corners, respectively, for cooperating with corresponding attachment structures of the hip support to transmit load from the frame to the hip support. Load on the frame is thus transmitted through the struts to the hip support via the struts.

In accordance with yet another aspect of the invention, a hip belt assembly is provided for a load carrying system including a load support configured to be worn behind a user's back and shoulder supports coupled to the load support for partially suspending the load support from the user's shoulders. The hip belt assembly includes a load support belt and a hip pad. The load support belt is configured to surround a user's hips when worn and to be coupled to the load support. The support belt includes a first component of a hook and loop fastening system provided on an inner surface thereof. The hip pad is configured to be worn between the load support belt and the use's hips. The pad has a second component of a hook and loop fastening system provided on an outer surface thereof, the first and second components of the hook and loop fastening system cooperating to maintain the hip pad in a desired position with respect to the load support belt when worn by a user.

In accordance with still another aspect of the invention, a load support system includes a load support and a pair of shoulder supports. The load support is configured to be carried behind a user's back and has a plurality of attachment points. The attachment points are disposed in an array of locations vertically and horizontally displaced with respect to one another. Each of the shoulder supports has an attachment end configured to cooperate with an attachment point of the load support to selectively couple the shoulder support to the load support at desired locations. The shoulder supports may be thus independently secured to the load support in a plurality of vertical and horizontal locations.

BRIEF DESCRIPTION OF THE DRAWINGS

The present invention will become more fully understood from the following detailed description, taken in conjunction with the accompanying drawings, wherein like reference numerals refer to like parts, in which:

FIG. 3 is a partially exploded perspective view of the system shown in FIG. 1 removed from the backpack and showing a hip belt assembly removed from a flexible frame unit;

FIG. 4 is a rear perspective view of a preferred embodiment of the hip belt assembly shown in FIGS. 1 and 2;

FIG. 7 is a side view of the frame coupled to the hip belt assembly;

FIG. 8 is a side view of a portion of the frame and hip belt assembly, shown in partial section along line 8—8 of FIG. 6 and illustrating a preferred arrangement for limiting movement of the belt assembly with respect to the frame;

FIG. 9 is a top view of the frame and hip belt assembly coupled to one another, illustrated in partial section along line 9—9 of FIG. 6, illustrating a venting space provided between the belt and frame in a preferred embodiment of the invention;

FIG. 10 is a partially exploded view of one of the shoulder straps of the shoulder strap assembly shown in FIG. 2;

FIG. 11 is an exploded perspective view of the shoulder strap of FIG. 10;

FIG. 12 is a detail view of a preferred connection arrangement used to couple certain of the straps of the load support system to support elements;

FIG. 13 is a sectional view through line 13—13 of FIG. 12 of an exemplary pin included in the arrangement of FIG. 12;

FIG. 22 is a rear view of the frame structure of the embodiment of FIG. 20, illustrating the manner in which the shoulder strap assembly is retained on the frame;

FIG. 23 is a perspective view illustrating how the hip belt assembly of the embodiment of FIG. 20 is retained on the frame;

DESCRIPTION OF THE PREFERRED EMBODIMENTS

Figure 1:
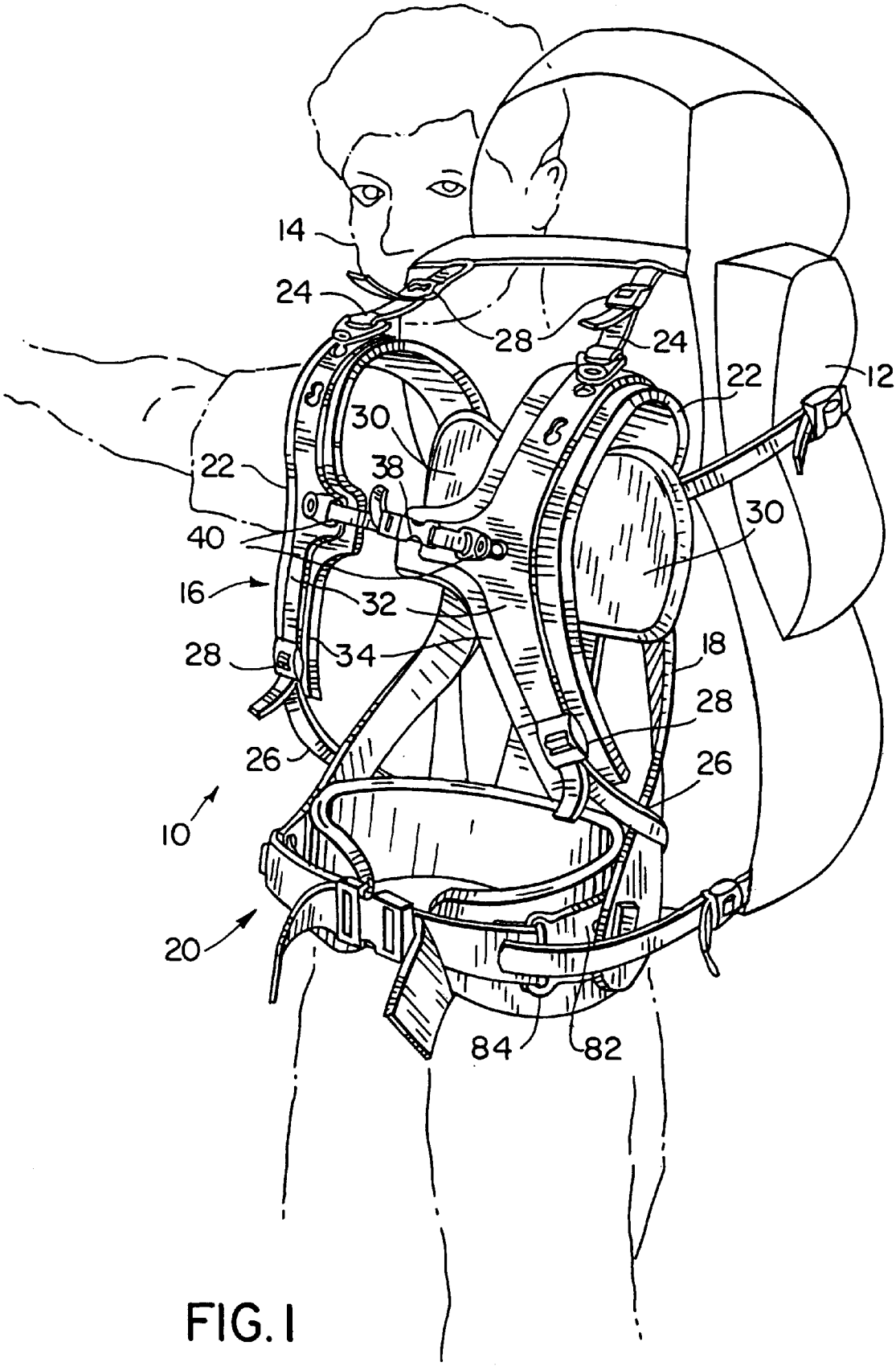
FIG. 1 is a perspective view of a load support system coupled to a backpack.
Figure 2:
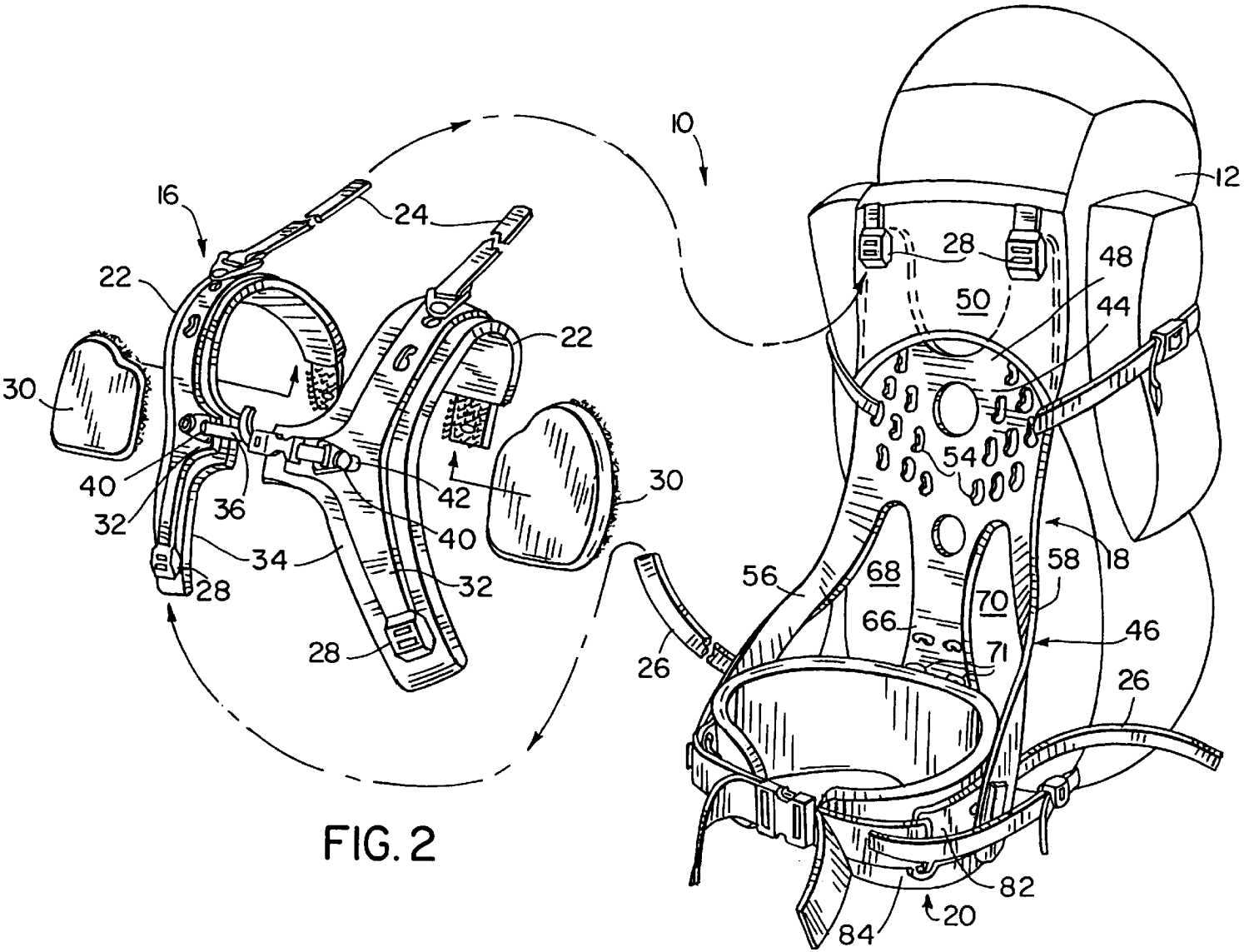
FIG. 2 is a partially exploded perspective view of the system shown in FIG. 1 showing a shoulder strap assembly removed from a frame and belt assembly.

Turning now to the drawings and referring to FIGS. 1 and 2, a load support system 10 is illustrated as adapted for supporting and carrying a backpack 12 on the shoulders and hips of a user 14. As illustrated in FIG. 1, load support system 10 includes a shoulder support assembly, designated generally by the reference numeral 16, a flexible frame 18 and a hip belt assembly 20.

Shoulder support assembly 16 includes a pair of shoulder supports 22 secured to frame 18. Upper and lower flexible webbing straps 24 and 26 serve to attach supports 22 to pack 12 and to a lower portion of frame 18, respectively. Upper and lower webbing straps 24 and 26 are preferably adjustably and releasably secured to supports 22 via ladder locks 28 . Thus, shoulder support assembly 16 may be removed from pack 12 and frame 18 by unbuckling straps 24 and 26 from ladder locks 28, and uncoupling attachment pins (described in greater detail below) as shown in FIG. 2. When attached between supports 22, pack 12 and frame 18, straps 24 and 26 may be adjusted to comfortably position and distribute the load within pack 12 by drawing or releasing straps them through ladder locks 28 in a conventional manner. Back pads 30 are removably positioned over portions of shoulder supports 22 where the supports are attached to frame 18, preferably via hook and loop fastening means provided on the surfaces of these elements. Each shoulder support 22 preferably includes a semirigid load bearing strap 32 secured to a pad 34 via similar hook and loop structures as described below. Shoulder supports 22 may be releasably coupled to one another via a sternum strap 36, including a quick release buckle 38. Upper webbing straps 24 and sternum strap 36 are preferably removably coupled to load bearing straps 32 via coupling members 40 engaged in corresponding slots 42, as described in greater detail below.

As best illustrated in FIG. 2, frame 18 includes an upper portion 44 and a lower portion 46. Upper and lower portions 44 and 46 are preferably both formed as part of a unitary, flexible structure made of a deformable plastic material, as described more fully below. Extending from upper portion 44, frame 18 comprises a supporting projection 48 (see FIG. 3) configured to slip into and remain lodged in a pocket 50 formed in pack 12. In the embodiment illustrated, projection 48 forms a pair of panels 52, each projecting substantially from the main body of upper portion 44, such as for supporting a large, high capacity pack. Alternatively, projection 48 could be of lower profile and may form a single panel, such as for supporting smaller packs. In addition to projection 48, upper portion 44 of frame 18 includes slots or attachment apertures 54, similar to slots 42 of supports 22, for releasably securing shoulder supports 22 to frame 18 as described below.

Figure 6:
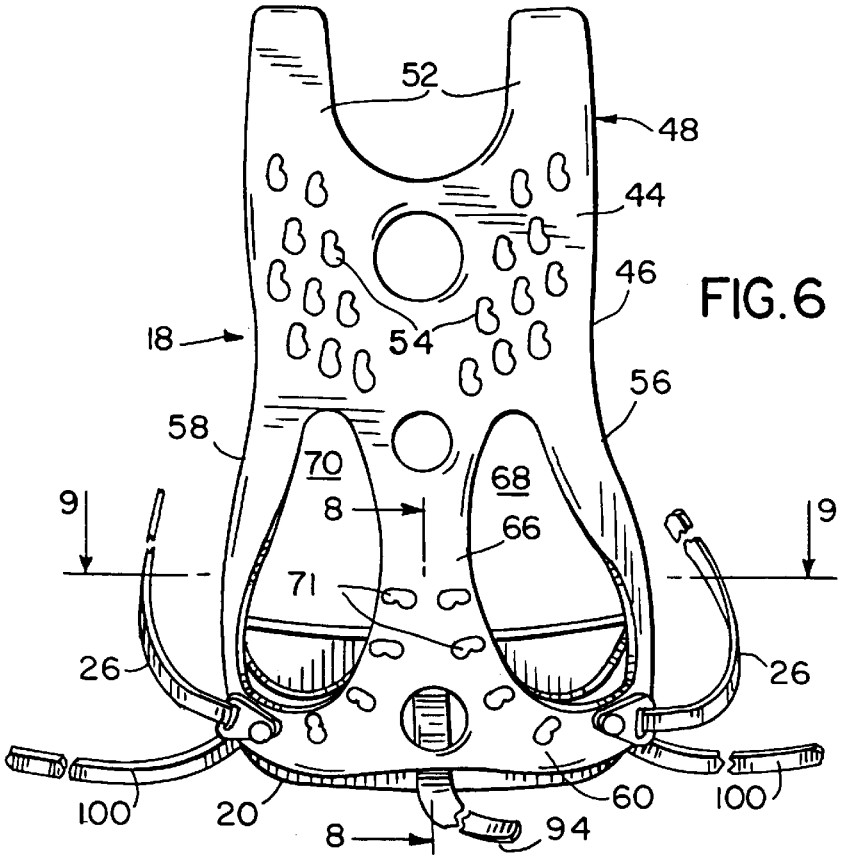
FIG. 6 is a rear view of the frame coupled to the hip belt assembly.

Extending from upper portion 44, lower portion 46 of frame 18 forms left and right struts 56 and 58 that join a lower panel 60 at left and right lower corners 62 and 64, respectively, as best seen in FIGS. 2, 3 and 6. Between struts 56 and 58, lower portion 46 preferably includes a central panel 66 separated from struts 56 and 58 by open regions 68 and 70. A series of attachment apertures or slots 71, generally similar to slots 42 and 54, extends on either side of central panel 66 onto lower panel 60 for attaching frame 18 to lower webbing straps 26 as described below. At left and right lower corners 62 and 64, frame 18 includes left and right lateral attachment points 72 and 74 designed to receive and cooperate with corresponding attachment supports of hip belt assembly 20 to transfer load from pack 12, through frame 18 and to hip belt assembly 20.

In the preferred embodiment shown, frame 18 is formed from a unitary piece of plastic, such as by die cutting or molding. It should be noted, however, that as used herein, the term "unitary" refers to the final construction of frame 18 rather than any particular method of manufacture. Thus, a welded, fused or glued assembly of elements forming a similar structure would be considered, for the present purposes, to be a unitary structure. Moreover, while in the presently preferred embodiment frame 18 is formed from 3/16 inch thick ABS plastic sheet, other flexible materials may be substituted. The material forming frame 18 may be thermoformed, such as by drape molding to lend frame 18 a bow or camber such that lower corners 62 and 64 curve inwardly toward the user. This bow or camber may include arching of projection 48 as well as wrapping of struts 56 and 58 forwardly, as shown in the FIGURES. The latter contour is particularly preferred to facilitate attachment of frame 18 to hip belt assembly 20 as described below. Where frame 18 is to be used for particularly heavy loads or where additional flexure is desired, one or more additional strips of flexible material may be secured, such as by gluing or fusing, to each strut 56, 58 to increase its column and bending loading capacity without unnecessarily increasing the overall thickness or weight of other portions of frame 18. As will be appreciated by those skilled in the art, the flexibility of frame 18 permits elastic deformation during use, allowing frame 18 to move with the user, particularly through twisting-type movements of the waist and torso. Moreover, while permitting such movement, struts 56 and 58 are generally placed in compression to effectively transmit loads on frame 18 to hip belt assembly 20, thereby allowing the user to carry a greater portion of the load on the hips and legs, and relieving the shoulders and back from excessive loading.

Frame 18 is releasably coupled to hip belt assembly 20 by coupling lower lateral attachment points 72 and 74 to attachment supports 76 and 78 (see FIGS. 3, 7 and 9). In the embodiment illustrated, attachment points 72 and 74 include slotted apertures, while attachment supports 76 and 78 include support pins 80 extending from a semirigid support belt 82. The preferred structure for securing attachment supports 80 to attachment points 72, 74 is described below with reference to FIGS. 15–19.

Figure 5:
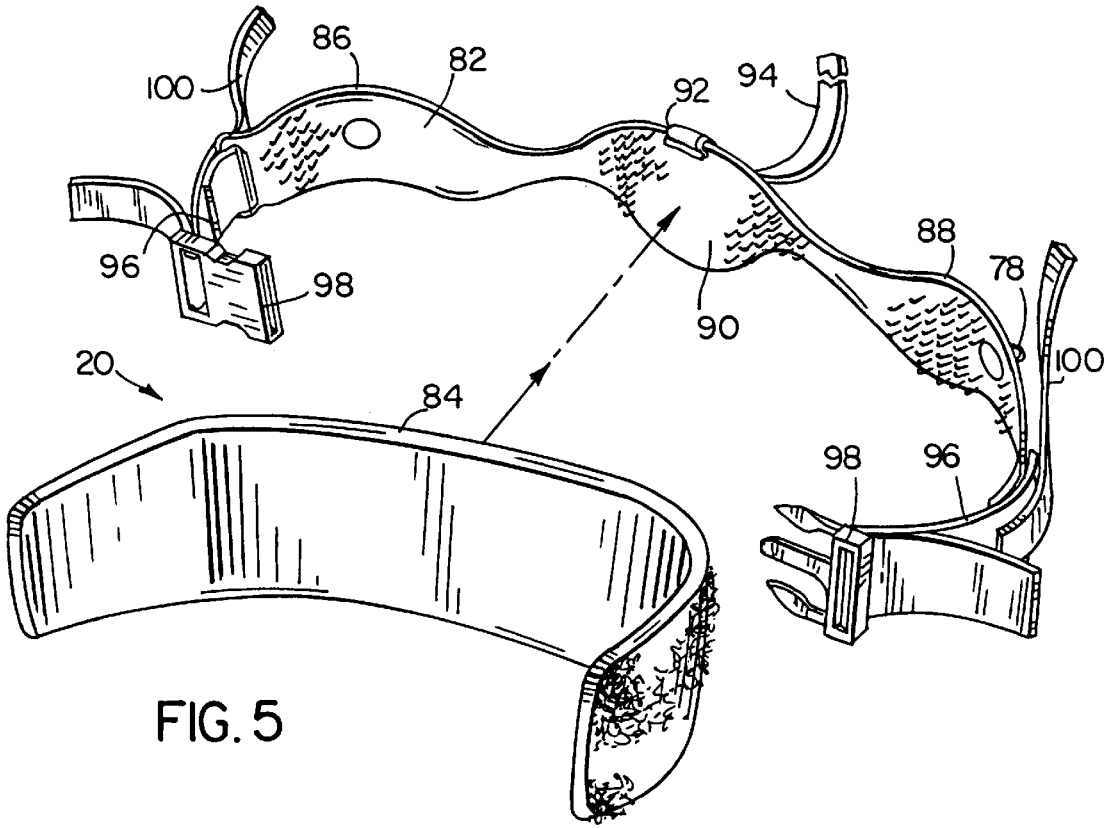
FIG. 5 is an exploded perspective view of the preferred embodiment of the hip belt assembly of FIG. 4.

In the preferred embodiment of belt assembly 20 illustrated in FIGS. 3, 4 and 5, support belt 82, which is cut or stamped and molded of a single piece of deformable plastic material, is secured to a hip pad 84 via hook and loop attachment means formed on mutually facing surfaces of belt 82 and pad 84. Enlarged lateral regions 86 and 88 support pins 80, while an enlarged rear region 90 includes a slot 92 for receiving a lumbar strap 94 for aiding in adjusting the distribution of loading between belt assembly 20 and frame 18 as described below. Webbing straps 96 are coupled to the front of support belt 82 and may be selectively jointed by an adjustable buckle 98. Stabilizing straps 100, preferably sewn to webbing straps 96, extend toward pack 12 and may be coupled to pack 12 by ladder locks 102 or similar adjustable attachment means, for stabilizing pack 12 in a manner generally known in the art. It should be noted that, while in use belt assembly 20 may support a considerable portion of the load within pack 12, connection between support belt 82 and hip pad 84 will be adequately maintained due to the character of the loading of hip pad 84 and the resistance of the hook and loop attachment to sliding movement of these elements with respect to one another. This preferred embodiment permits hip belt assembly 20 to provide comfortable and effective load support, while eliminating the need for stitching through pad 84 as in conventional designs.

As best illustrated in FIGS. 3, 6, 7 and 9, hip belt assembly 20 is secured to frame 18 as follows. Attachment supports 76 and 78 of assembly 20 are aligned with attachment points 72 and 74, respectively, and snapped into engagement therewith. Such engagement preferably requires additional bowing or deformation of frame 18, placing a portion of belt assembly 20 between attachment supports 76 and 78 somewhat in tension. Lumbar strap 94 is then fed beneath frame 18, and secured to pack 12. As shown in FIG. 7, once secured to frame 18, hip belt assembly 20 provides pivotal support for loads transmitted through struts 56 and 58 to the attachment points of frame 18 and the attachment supports of assembly 20. In particular, assembly 20 is free to rotate or pivot upwardly and downwardly about its points of attachment to frame 18 as indicated by arrows 104 and 106. Thus, in addition to the flexibility afforded by deformation of flexible frame 18, pivotal movement of assembly 20 and frame 18 affords the user considerable freedom of movement, particularly in forward and backward directions. Lower or lumbar strap 94 serves to limit pivotal movement of assembly 20 with respect to frame 18, stabilizing pack 12 and improving distribution of loading between frame 18 and assembly 20. As shown in FIG. 8, strap 94 is looped through slot 92 in enlarged rear region 90 of belt 82. From belt 82, strap 94 passes beneath lower panel 60 (see FIG. 3), and is coupled, via a ladder lock 108 (see FIG. 8) or similar adjustable fastener, to the bottom of pack 12. By properly adjusting the length of lumbar strap 94, the user may limit the upward pivotal movement of belt assembly 20 with respect to frame 18 as indicated by arrow 110 in FIG. 8.

Another advantageous feature of the load support system described above is the creation of a venting space between hip belt assembly 20 and frame 18. As best illustrated in FIG. 9, attachment of assembly 20 to frame 18 effectively places an intermediate portion 112 of hip belt assembly 20, located between attachment supports 76 and 78, in mutually facing relation with an intermediate portion 114 of frame 18 located between attachment points 54 and 56. Because the length of intermediate portion 112 is shorter than the length of intermediate portion 114, frame 18 is placed and held in a bowed or arched configuration with a venting or air flow space 116 being created frame 18 and belt assembly 20. This spacing holds pack 12 away from the user's back and facilitates evaporation of perspiration from the user's back, further enhancing the comfort of the support system.

FIGS. 10 and 11 illustrate a presently preferred embodiment for shoulder supports 22. As mentioned above, each shoulder support 22 includes a semirigid load bearing strap 32 and a shoulder support pad 34 held in place beneath the load bearing strap 32 by hook and loop, or similar separable attachment means. Load bearing strap 32 includes rear attachment end 118 carrying an attachment pin 120. At an opposite end, strap 32 preferably carries ladder lock 28 for coupling to lower webbing strap 26 (refer to FIG. 2). At intermediate locations, each strap 32 includes a series of slots 42 for receiving coupling members 40 of upper webbing straps 24. A lateral extension 122 of strap 32 includes a similar slot 42 for receiving coupling member 40 of sternum strap 36. Load bearing straps 32 are preferably made of a sturdy plastic material, such as polypropylene plastic. This preferred structure of shoulder supports 22 provides comfortable load support, while permitting considerable adjustability to adapt the support configuration to the frame of the user. Moreover, as will be appreciated by those skilled in the art, the form of strap 32 illustrated in the FIGURES is adapted to follow the direction of loading on supports 22. In particular, straps 32 converge toward extensions 122. It should also be noted that the preferred embodiment of supports 22 obviates the need to stitch or otherwise permanently attach pads 34 to straps 32, thereby facilitating the manufacture of the system and further enhancing its flexibility.

As best illustrated in FIGS. 2 and 10, shoulder strap assembly 16 is attached to frame 18 as follows. Pads 34 are positioned on straps 32 and pressed into place to lock the hook and loop fasteners. Pins 122 of rear attachment ends 118 are then inserted into appropriate slots 54 of frame 18 (as described in greater detail below) and ladder locks 28 are secured to lower webbing straps 28. Coupling members 40 of upper webbing straps 24 are positioned in slots 42 of straps 32. Back pads 30 are then positioned over rear attachment ends 118 and pressed into place to lock the hook and loop fasteners carried by those elements.

As best shown in FIGS. 3 and 6, lower webbing straps 26 may be positioned in one of several supported slots 71. In general, slots 71 are disposed adjacent to one another upper positions on central panel 66 and in divergent locations along lower panel 60 of frame 18. This preferred location of slots 71 provides adjustability of both the length of shoulder supports 22 and of the lateral location at which shoulder supports 22 pull inwardly towards the user's back. It should also be noted that slots 54 for receiving the rear attachment ends of load bearing straps 32 are preferably provided in a pattern affording both lateral and vertical adjustability. As will be appreciated to those skilled in the art, this feature of load support system 10 provides extremely versatile, independent adjustment both of the width, height and length of shoulder supports 22.

Figure 27:
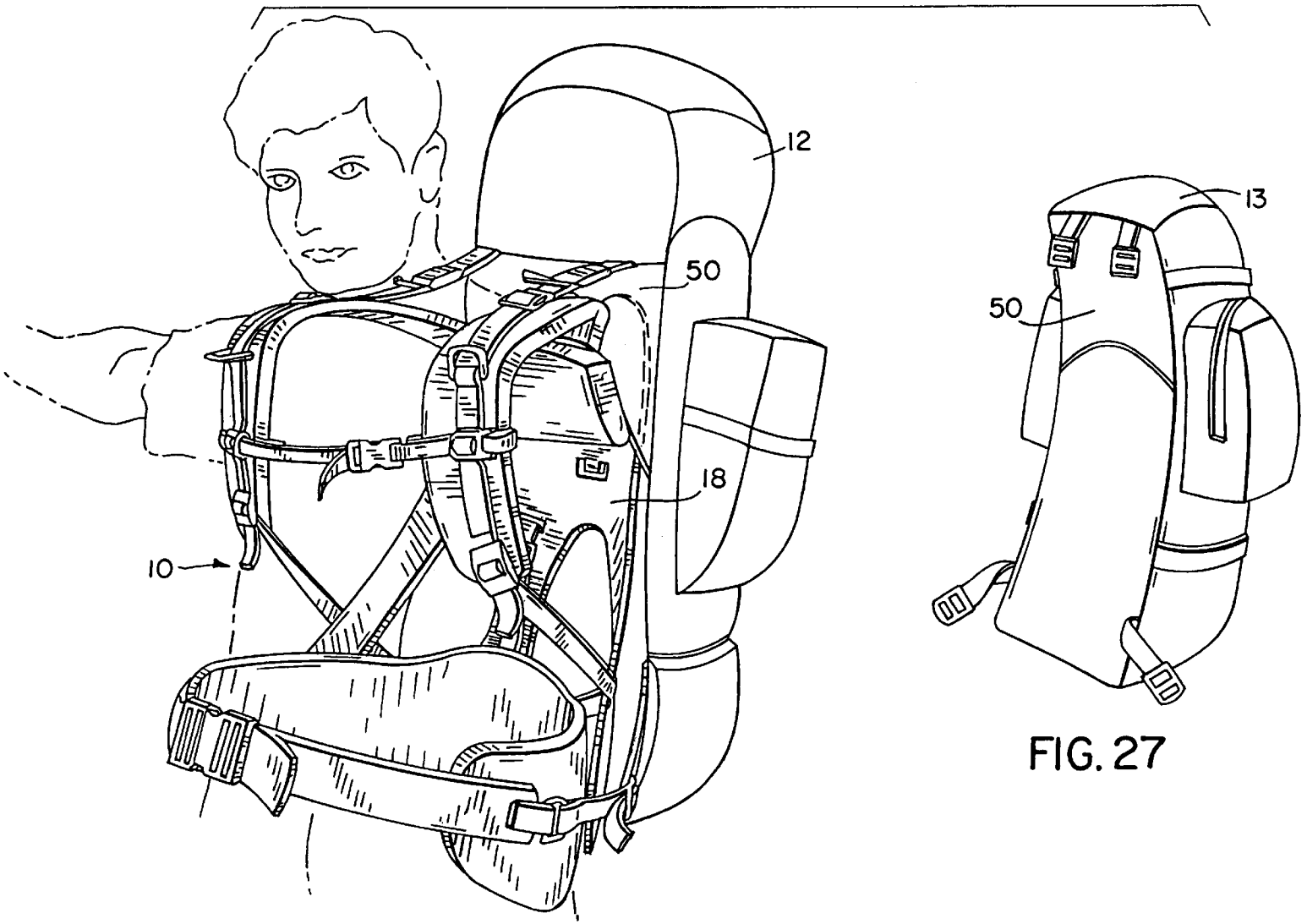
FIGS. 27 is a perspective view of a suspension system in accordance with the invention, illustrating how the system may be interchangeably used to support loads, such as backpacks, of different capacities or types.

Shoulder strap assembly 16, frame 18 and hip belt assembly 20, once assembled, form load support system 10, which may be then be attached to pack 12. For attachment to pack 12, upper supporting projection 48 is slid into pocket 50, and upper straps 24, lumbar strap 94 and stabilizing straps 100 are fastened to their corresponding buckles or ladder locks and adjusted to a comfortable fit. Removal of pack 12 from support system 10 follows the reverse steps. It should be noted that, as distinguished from conventional load support systems, system 10 affords quick and easy removal of all support structure from pack 12. Thus, support system 10 may be adjusted, sized or otherwise configured completely independently from pack 12. Moreover, as depicted in FIG. 27, loads supported on system 10 may be easily and quickly changed by removal of one pack 12 and replacement on system 10 of another pack 13. Thus, by way of example, for extended expeditions, system 10 could be used to support a large capacity pack 12, used to arrive at a desired location, such as a base camp. Thereafter, system 10 can be detached from pack 12 and used to support a smaller or different pack 13, such as a day pack, designed to interface with system 10 and originally carried within pack 12. As will be apparent to those skilled in the art, a wide range of packs and other load carrying structures may be substituted for packs 12 and 13. In addition, system 10 may be adapted for supporting various loads, such as SCUBA diving tanks, and the like.

FIGS. 12 and 13 illustrate the presently preferred embodiment of the connecting arrangement for securing upper and lower webbing straps 24 and 26 to frame 18, as well as for securing sternum strap 36 to load bearing straps 32. As shown in FIG. 12, a coupling member 40 carries a pin 124 having a shank 126 and an enlarged head 128. Slot 42, 52 or 71 has an enlarged region 130 of sufficient diameter to permit passage of head 128, a region of reduced diameter 132 and a passage 134 extending between regions 130 and 132. Shank 126 of pin 124 is generally cylindrical, but includes a flat 136 extending along its length, providing shank 126 with a thickness l in one direction (i.e. perpendicular to flat 136) less than its diameter d in other directions. Passage 134 is dimensioned slightly wider than the dimension l, but smaller than the dimension d. Thus, passage 134 permits passage of shank 126 only when shank 126 is turned to align flat 136 with passage 134. To secure coupling member 40 to slot 42, 52 or 71, head 128 is inserted through enlarged region 130 and member 40 is turned to align flat 136 with passage 134. Member 40 may then be engaged within slot 42, 52, or 71 by sliding pin 124 toward region of reduced diameter 132 and twisting member 40 so as to misalign flat 136 and passage 134. Thereafter, pin 124 will be retained by abutment of shank 126 with the portion of the slot surrounding region 132. Removal of pin 124 from the slot is accomplished by realignment of flat 136 with passage 134. Attachment of pin 120 of rear attachment end 118 is generally identical to that described above, with the exception that pin 120 is carried directly on end 118. It should be noted that in the preferred embodiment of system 10 described above, passages 134 of the various attachment slots is oriented such that flats 136 of corresponding pins will not be aligned with passages 134 in the normal loading orientation of the attached members. For example, slots 71 for the attachment of lower webbing straps 26 are oriented such that coupling members 40 will be engaged and blocked from removal when straps 26 are tensioned in use. Thus members 40 will generally be blocked from accidentally escaping from their engagement slots during use.

Figure 14:
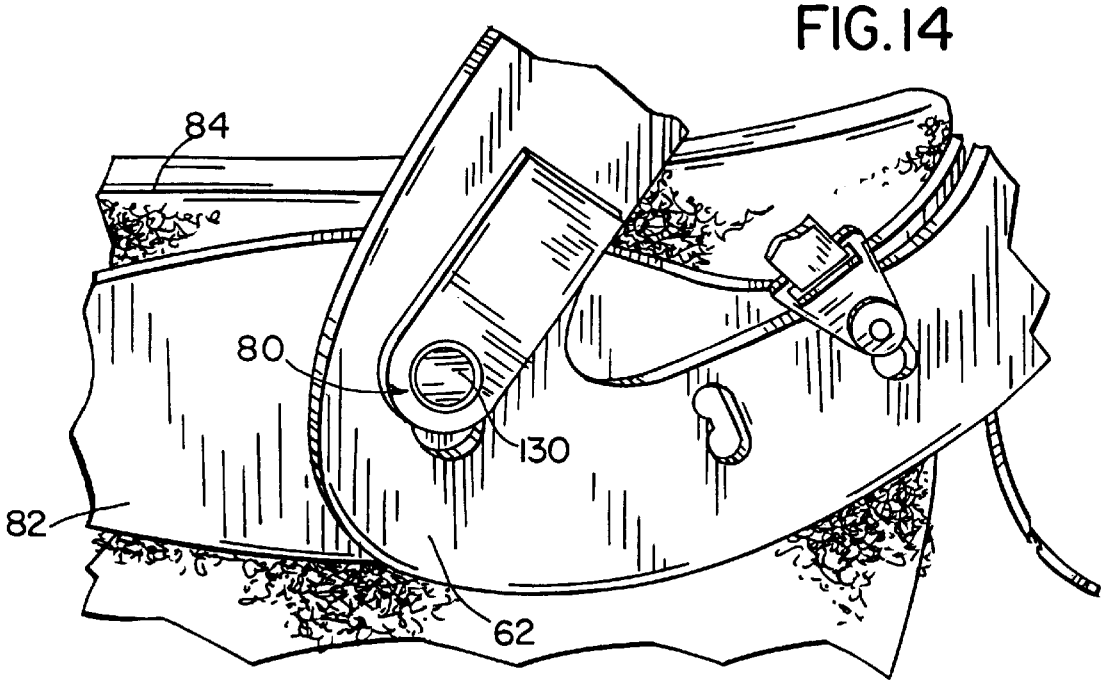
FIG. 14 is a partial side view of the belt assembly coupled to a lower corner of the frame.
Figure 15:
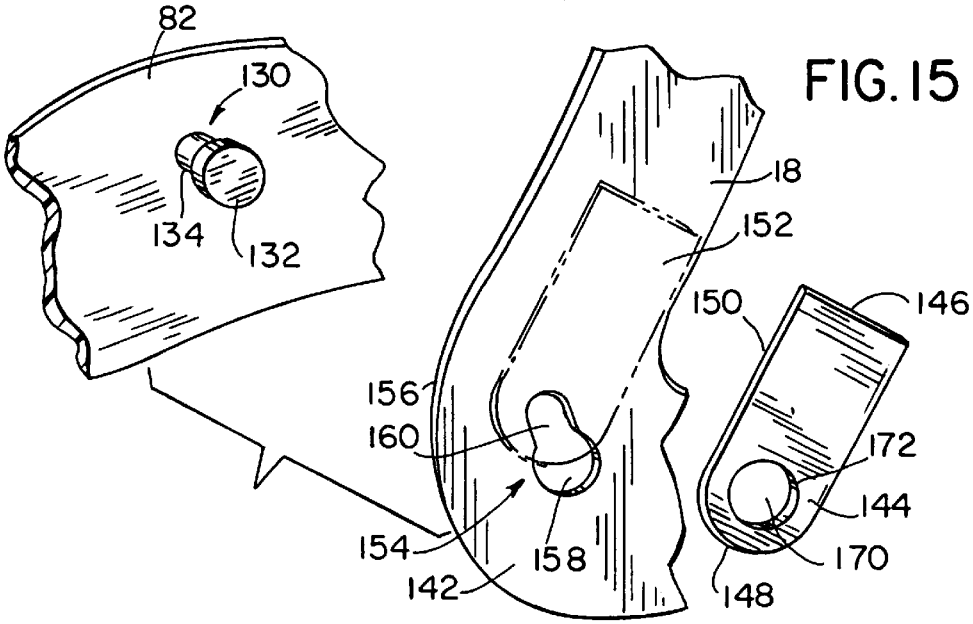
FIGS. 15–19 are detail views of a preferred structure for attaching the belt assembly to the frame.

FIGS. 14 through 19 illustrate a presently preferred structure for pivotally attaching frame 18 to hip belt assembly 20. As shown in FIG. 14, hip belt assembly 20 is secured to each lower corner of frame 18 (left lower corner 62 shown in FIG. 14), by an attachment support 80 in the form of a rigid, load bearing pin 130 extending from support belt 82. Pin 130 has an enlarged head portion 132 offset a distance d from support belt 82 by a shank portion 134 (see FIGS. 16 and 17). Head portion 132 has an inner annular face 136, an outer circular face 138, and a cylindrical edge 140. Flexible frame 18 includes a frame base or base plate 142 at each lower corner, and a flexible, elongate latch plate or tab 144. Frame base 142 has a thickness t which is slightly less than distance d at which head portion 132 is offset from belt 82. Latch tab 144 has a distal end 146 and a proximal end 148, and is secured along a face 150 near distal end 146 to fixedly secure latch tab 144 to an outer face 152 of frame 18. Due to the inherent resiliency of tab 144, face 150 of latch tab 144 is biased toward face 152 of frame 18. Latch tab 144 may be secured to frame 18 by any method known in the art suitable for the materials used, such as by an RF weldment, if plastics are used, gluing, riveting or a similar procedure.

Each lower corner of frame 18 includes a elongate opening 154 extending from face 152, through frame 18, to an opposite face 156. Elongate opening 154 has an enlarged end 158 of sufficient size to allow head portion 132 of pin 130 to pass therethrough, and an end 160 or reduced dimensions for receiving and establishing coupling engagement with shank portion 134 of pin 130. Preferably, elongate opening 154 has a generally rounded, smooth edge 162 circumscribing elongate opening 154 along face 152 and a generally rounded, smooth edge 164 circumscribing elongate opening 154 along face 156 (see FIGS. 16 and 17). Also preferably, elongate opening 154 has a pair of generally rounded, smooth transition edges 166, 168 between enlarged end 158 and reduced end 160.

Figure 16:
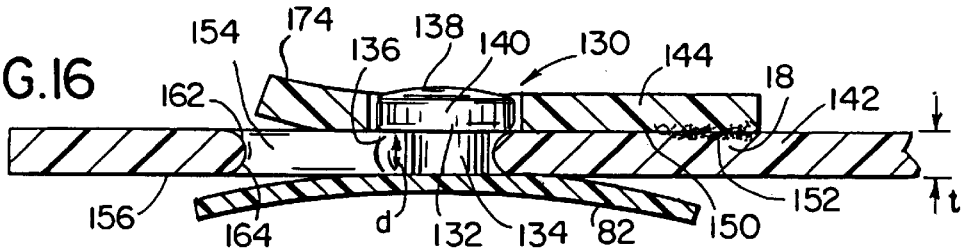
Figure 17:
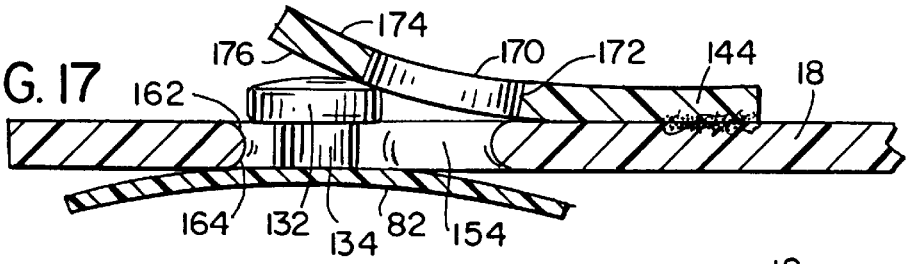
Figure 18:
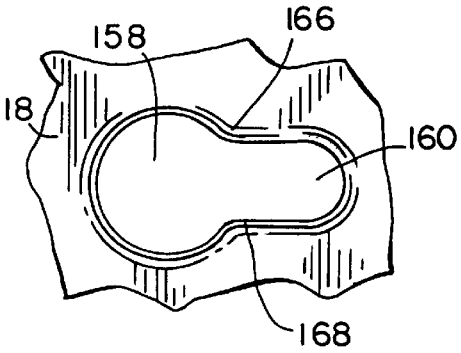

As best illustrated in FIGS. 16 and 17, latch tab 144 has a pin retaining hole 170 for receiving head portion 132 of pin 130, wherein hole 170 is defined by a cylindrical head engaging edge 172 for engaging cylindrical edge 140 of head portion 132 of pin 130. Retaining hole 170 overlies reduced end 160 and is larger in diameter than the width of reduced end 160. Proximal end 148 of latch tab 144 extends over retaining hole opening 154 and is preferably bent slightly away from opening 154 to form an upturned lip 174 for ensuring that latch tab 144 is easy for a user to manipulate. The portion of latch tab 144 extending over enlarged end 158 of elongate opening 154 thus forms a cam-like surface 176.

Pin 130 is latched into pivotal engagement with frame 18 by inserting pin 130 through enlarged end 158 of elongate opening 154. This movement causes circular face 138 of head portion 132 to press into cam surface 176 of latch tab 144, causing latch tab 144 to flex away from frame base 142 (see FIG. 17). Pin 130 is then moved along elongate opening 154 toward reduced end 160 until head portion 132 of pin 130 is lined up with retaining hole 170 of latch tab 144. At this point, circular face 138 disengages from cam surface 176, and latch tab 144 snaps back into its biased latching position adjacent to frame base 142. Pin 130 is thereby securely latched into engagement with frame 18 (see FIG. 16). Pin 130 is unlatched from frame 18 for removal of hip belt assembly 20 as follows. The user first pressed upturned lip 174 upwardly, flexing tab 144 away from frame base 142. Pin 130 is then moved laterally along elongate opening 154 toward enlarged end 158. When head portion 132 of pin 130 is aligned with enlarged end 158, head portion 132 can be moved transversely back through enlarged end 56 to fully disengage the assembly.

Figure 19:
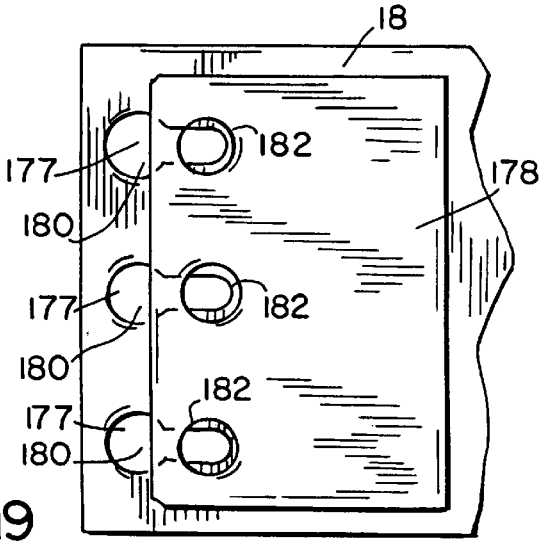

Referring now to FIG. 19, a variant of the embodiment described above is illustrated for providing several pivotal attachment points 177 on frame 18 with a single latching tab 178. In this variant, frame 18 includes several elongate openings 180, generally as described above, and tab 178 includes several retaining holes 182 overlying reduced dimension ends of openings 180. Pin 130 of support belt 82 may be selectively inserted into any one of openings 180, flexing tab 178 away from frame 18 as described above, and moved along the opening 180 until head portion 132 is received into a corresponding retaining hole 182 of tab 178.

Figure 20:
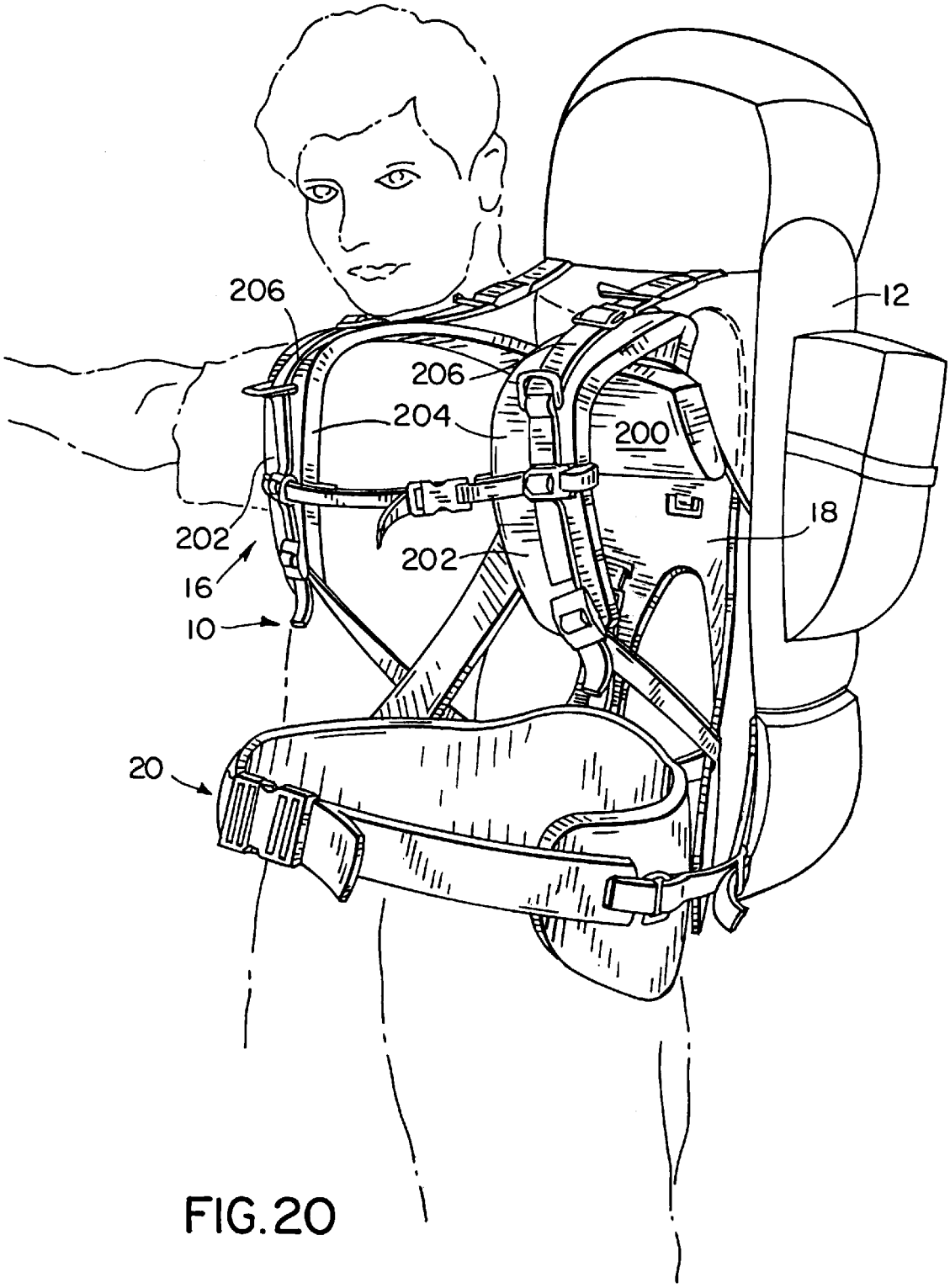
FIG. 20 is a perspective view of an alternative embodiment of the load support system shown in FIG. 1.
Figure 21:
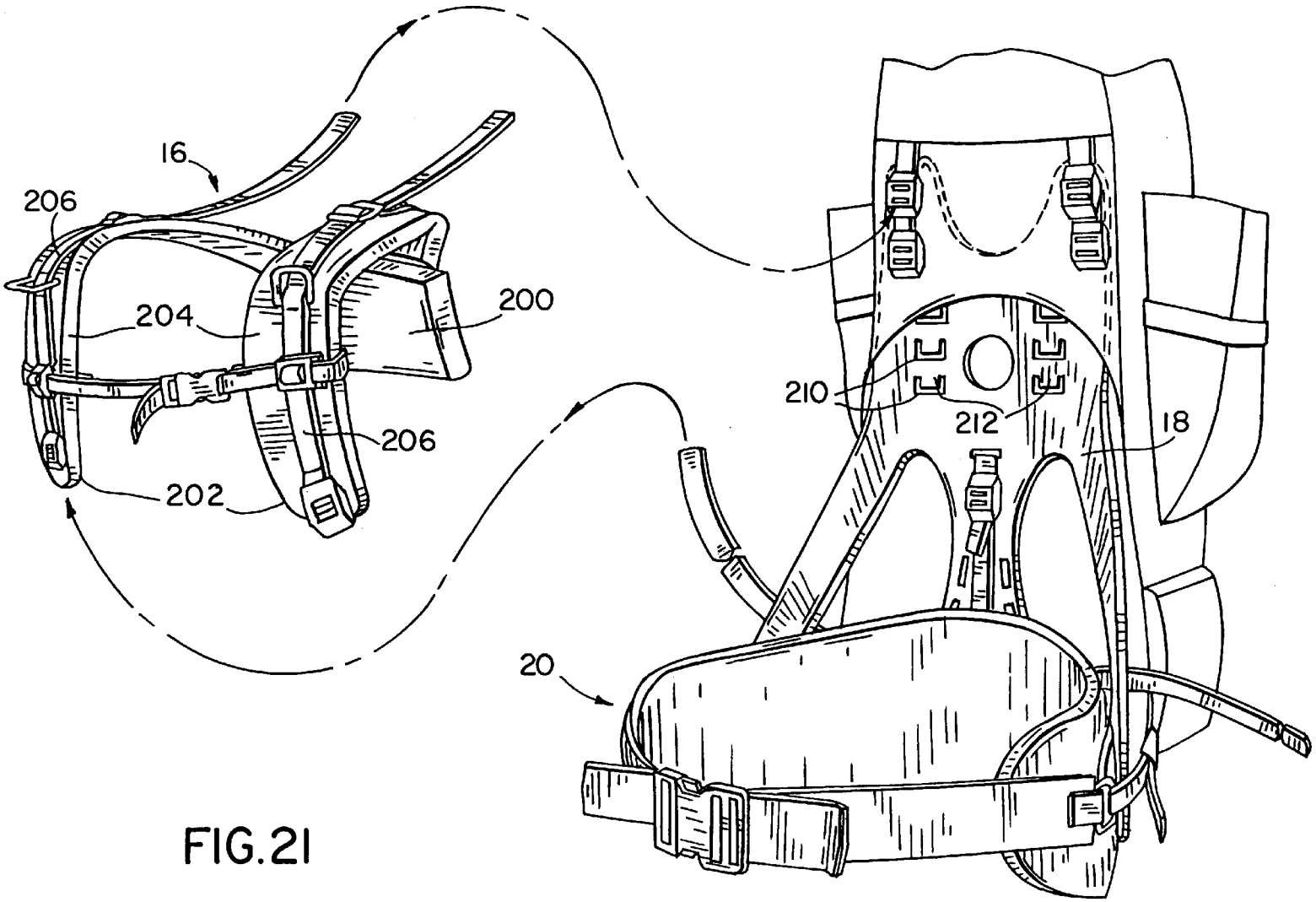
FIG. 21 is a perspective view of the embodiment shown in FIG. 20, with a unitary shoulder strap assembly removed.

FIGS. 20 through 26 illustrate alternative preferred embodiments for elements of load support system 10 described above. As shown in FIGS. 20, 21 and 22, an alternative structure for shoulder support assembly 16 includes a unitary back plate 200, permanently secured to shoulder straps 202. In the embodiment illustrated, shoulder straps 202 include integral pads 204 and webbing straps 206. Back plate 200 is removably secured to frame 18 as shown in FIGS. 21 and 22. Generally, plate 200 includes a series of D-shaped rings 208 extending rearwardly therefrom. Frame 18, in turn, includes a series of U-shaped slots 210 surrounding retaining tabs 212. Plate 200 is secured to frame 18 by inserting D rings 208 into corresponding slots 210 and urging plate 200 upwardly to engage tabs 212 into D rings 208. It should be noted that, while not permitting lateral position adjustment of shoulder straps 202, this embodiment nevertheless affords vertical adjustment of plate 200 on frame 18.

As shown in FIGS. 22 and 23, in the illustrated alternative embodiment, lower or lumbar strap 94 may be attached directly to frame 18, such as via a ladder lock 214 inserted through a slot 216 provided in frame 18. This arrangement eliminates the need to attach lumbar strap 94 to the backpack or other load supported on system 10. Also as illustrated in FIGS. 22 and 23, lower webbing straps 26 may be secured to frame 18 by similar ladder locks 218 inserted through and retained in slots 220 provided therefore in frame 18.

Figure 24:
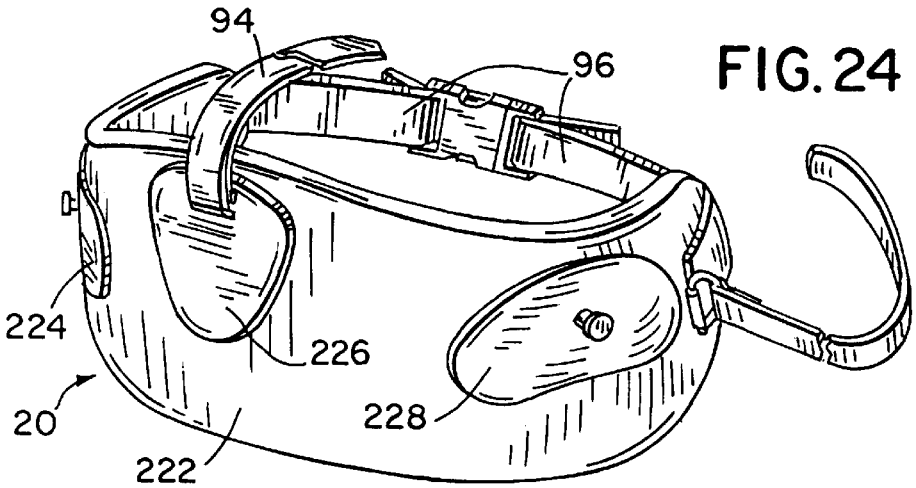
FIGS. 24, 25 and 26 are views of additional alternative embodiments of the hip belt assembly.
Figure 25:
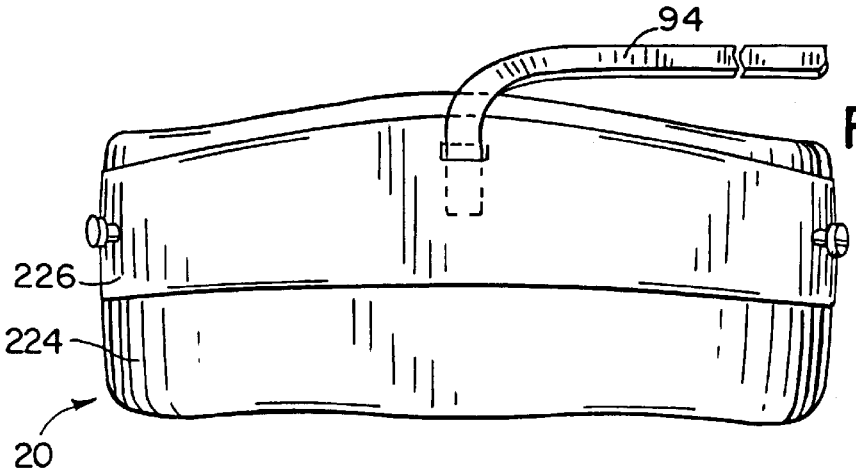
Figure 26:
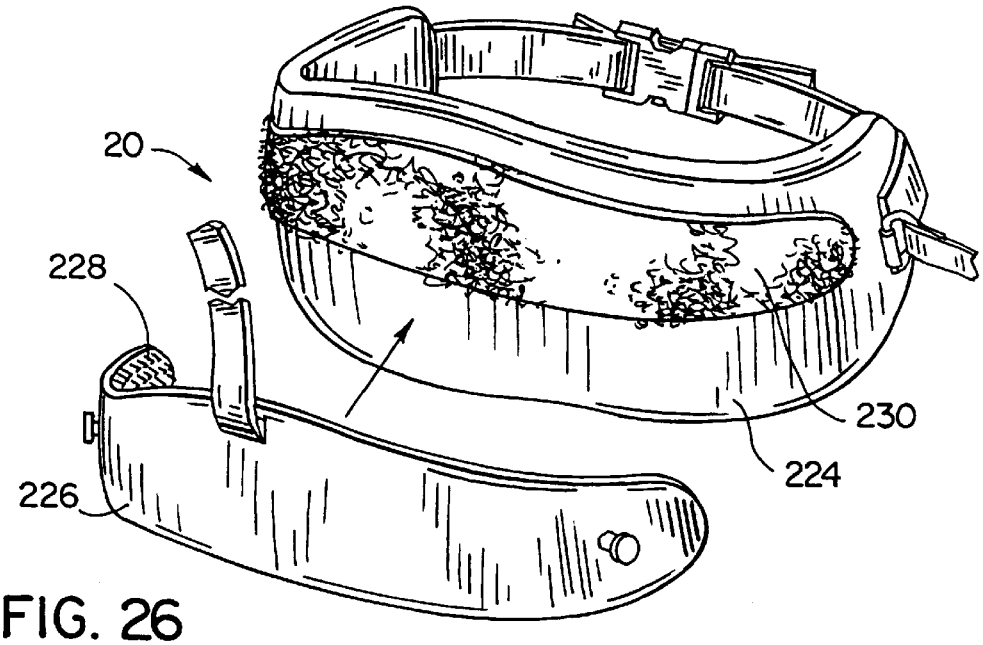

FIGS. 24, 25 and 26 illustrate preferred alternative embodiments of hip belt assembly 20. As illustrated in FIG. 24, rather than separate support and padding elements, assembly 20 may include an integral padded hip belt 222 on which load support patches 224, 226 and 228 are secured, such as by stitching. In this embodiment, webbing straps 96 for securing assembly 20 around a user's hips, would be attached directly to padded belt 222. Other elements of assembly 20 would function generally as described above. As shown in FIGS. 25 and 26, in a further alternative embodiment, assembly 20 may include a padded belt 224 and a load support panel 226 attached to belt 224 via hook and loop fastening system 228, 230 or a similar structure.

While the embodiments illustrated in the FIGURES and described above are presently preferred, it should be understood that these embodiments are offered by way of example only and may be adapted to various other structures.

I claim:

1. A system for supporting a load on a user's back and hips comprising:

a back support including a flexible and deformable frame and shoulder straps, the frame being coupled to the load and extending over a back region and around hip regions to lower first and second lateral attachment points, the shoulder straps being coupled to the frame for supporting the load on the user's shoulders; and a hip support adapted to be securely supported on the user's hips, the hip support having an inner surface adapted to be positioned against the user's body and an outer surface opposite the inner surface, the hip support further including:

first and second ends;

at least one connector connecting the first and second ends, the at least one connector having an uppermost edge extending in a first plane and a lowermost edge extending in a second plane; and first and second lateral attachment supports adjacent first and second portions of the outer surface, respectively, wherein the first and second lateral attachment supports of the hip support are located above the second plane and wherein the first and second attachment supports cooperate with the first and second lateral attachment points of the frame to pivotally support the frame on the hip support about first and second axes substantially perpendicular to the first and second portions of the outer surface, respectively, whereby the hip support provides flexible support for the load through the attachment points of the frame and the lateral attachment supports.

2. A system as set forth in claim 1, wherein the load is a backpack.

3. A system as set forth in claim 1, wherein the attachment points of the frame include apertures and the attachment supports of the hip support include pins configured to be received in the apertures.

4. A system as set forth in claim 1, wherein the attachment supports of the hip support are spaced from one another by a first distance and the attachment points of the frame are spaced from one another by a second distance greater than the first distance, whereby a venting space is defined by the frame when attached to the hip support.

5. A system as set forth in claim 1, wherein the frame is a unitary piece of deformable plastic material.

6. A system as set forth in claim 1, wherein the frame is separable from the hip support.

7. A system as set forth in claim 1, wherein the hip support includes a hip belt.

8. A system as set forth in claim 7, wherein the hip belt is separable from the attachment supports.

9. The system of claim 1 wherein each of the lateral attachment supports of the hip support are located between the first plane and the second plane.

10. A system for supporting a load on a user's back and hips comprising:

a back support including a flexible frame and shoulder straps, the frame being unitary flexible structure made of a plastic material, the frame being coupled to the load and extending over a back region and around hip regions to lower lateral attachment points, the shoulder straps being coupled to the frame for supporting the load on the user's shoulders; and a hip support adapted to be securely supported on the user's hips, the hip support having an inner surface adapted to be positioned against the user's body and an outer surface opposite the inner surface, the hip support further including:

first and second ends;

at least one connector releasably connecting the first and second ends, the at least one connector having an uppermost edge extending in a second plane and a lowermost edge extending in a third plane; and first and second lateral attachment supports adjacent first and second portions of the outer surface, respectively, each of the lateral attachment supports of the hip support located above the second plane and cooperating with a lateral attachment point of the frame to pivotably support the frame on the hip support about first and second axes substantially perpendicular to the first and second portions of the outer surface, respectively, the attachment supports being spaced from one another by a first distance and the attachment points being spaced from one another by a second distance greater than the first distance, whereby attachment of the frame on the hip support retains the frame in a deformed configuration and creates a venting space adjacent and between the hip support and the frame.

11. A system as set forth in claim 10, wherein the load is a backpack.

12. A system as set forth in claim 10, wherein the attachment supports of the hip support are pivotally coupled to the attachment points of the frame, whereby the hip support may pivot about the attachment points with respect to the frame.

13. A system as set forth in claim 10, wherein the attachment points include apertures and the attachment supports include pins configured to be received in the apertures.

14. A system as set forth in claim 10, wherein the frame is separable from the hip support.

15. A system as set forth in claim 10, wherein the hip support includes a hip belt configured to encircle the user's hips.

16. The system of claim 10 wherein each of the lateral attachment points are located between the first plane and the second plane.

17. A frame for a load support system, the load support system including a load carrying structure, shoulder straps for supporting the load carrying structure on the user's shoulder, and a hip support for supporting the load carrying structure on the user's hips, the frame comprising:

a flexible panel of deformable plastic material having left and right lateral struts extending at an angle from an upper region of the frame to left and right lower corners, respectively, along the user's hip bone;

left and right attachment points located at the left and right lower corners, respectively, for cooperating with corresponding attachment structures of the hip support to transmit load from the frame to the hip support wherein the left and right lateral struts terminate at the left and right attachment point; and a lower panel joining the left and right lateral struts between the left and right lower corners, wherein the left and right attachment points are located at intersections of the lower panel and the left and right lateral struts, respectively, whereby load on the frame is transmitted through the struts to the hip support via the struts.

18. A frame as set forth in claim 17 wherein the frame further comprises a central panel coupled to and located between the left and right struts.

19. A frame as set forth in claim 17, wherein the frame includes a projection in the upper region configured to be removably received in a pocket of the load carrying structure.

20. A frame as set forth in claim 17, wherein the frame is deformed when coupled to the hip support, whereby a venting space is defined between the frame and the hip support.

21. A frame as set forth in claim 17, wherein the left and right attachment points are configured for pivotal attachment to the hip support.

22. A frame as set forth in claim 17, wherein the frame is preformed to include a bow or camber.

23. A frame as set forth in claim 17, wherein the frame is sufficiently flexible to permit elastic deformation resulting from movement of the user when incorporated into the load support system and carried by the user.

24. A frame as set forth in claim 17, wherein the frame further comprises attachment slots for receiving and supporting the shoulder straps.

25. A frame as set forth in claim 17, wherein the frame includes at least one open region between the left and right struts.

26. A hip belt assembly for a load carrying system including a load support configured to be worn behind a user's back and shoulder supports coupled to the load support for partially suspending the load support from the user's shoulders, the hip belt assembly comprising:

a load support belt having an inner surface adapted to be positioned against the user's body and an outer surface opposite the inner surface, wherein the belt is configured to surround a user's hips when worn and to be coupled to the load support, the load support belt including:

first and second ends;

at least one connector connecting the first and second ends, the at least one connector having an uppermost edge extending in a first plane and a lowermost edge extending in a second plane; and first and second lateral attachment supports located above the second plane adjacent first and second portions of the outer surface, respectively, the first and second lateral attachment supports of the hip support cooperating with first and second lateral attachment points of the frame to pivotably support the frame on the hip support about first and second axes extending substantially perpendicular to the first and second portions of the outer surface, respectively, whereby the hip support provides flexible support for the load through the attachment points of the frame and the lateral attachment supports; and a first component of a hook and loop fastening system provided on an inner surface thereof; and a hip pad configured to be worn between the load support belt and the user's hips, the pad having a second component of the hook and loop fastening system provided on an outer surface thereof, wherein at least one of the first and second components extend substantially along an entire length of one of the belt and the hip pad such that the first and second components of the hook and loop fastening system cooperate to maintain the hip pad in a desired position substantially anywhere along the length of the load support belt when worn by a user.

27. The hip belt assembly of claim 26 wherein each of the lateral attachment supports is located between the first plane and the second plane.

28. A load support system comprising:

a load support configured to be carried behind a user's back, the load support having a plurality of attachment portions providing a plurality of attachment points, the attachment points being disposed in an array of locations horizontally and vertically displaced with respect to one another, the plurality of attachment points including at least three horizontally spaced attachment points, wherein each attachment point comprises an opening; and a pair of shoulder supports, each shoulder support having an attachment end adjacent one of the plurality of attachment portions, wherein each attachment end has a pin having an axis extending through the opening of said one of the plurality of attachment portions, whereby each attachment end is configured to cooperate with an attachment point of the load support to selectively couple the shoulder support to the load support at desired locations for rotation about the axis of the pin.

29. A load support system as set forth in claim 28, wherein each shoulder support includes a load support strap and a pad, the load support strap being coupled to the pad solely by a hook and loop fastening system.

30. The load support system as set forth in claim 29, wherein the hook and loop fastening system extends along a majority of a length of one of the load support strap and the pad such that the pad may be positioned at a plurality of locations along the load support strap.

31. A load support system as set forth in claim 28, wherein the attachment points are in an upper region of a support frame and the attachment ends are at upper ends of the shoulder supports.

32. A load support system as set forth in claim 28, wherein the attachment points are in a lower region of a support frame and the attachment points are at lower ends of the shoulder supports.

33. A load support system as set forth in claim 28, wherein the attachment points are in upper and lower regions of a support frame and the attachment points are at upper and lower ends of the shoulder supports.

34. The load support system as set forth in claim 28, wherein the shoulder supports are pivotally coupled to the load support.

35. A system for supporting a load on a user's back and hips comprising:

a frame including:

a flexible panel of the deformable plastic material having left and right lateral struts extending at an oblique angle from a upper region of the frame to left and right lower corners, respectively;

left and right attachment points located at the left and right lower corners, respectively; and a lower panel joining the left and right lateral struts between the left and right lower corners, wherein the left and right attachment points are located at intersections of the lower panel and the left and right lateral struts, respectively;

a hip support adapted to be securely supported on the user's hips, the hip support having an inner surface adapted to be positioned against the user's body and an outer surface opposite the inner surface, the hip support further including:

first and second ends;

at least one connector connecting the first and second ends, the at least one connector having an upper most edge extending in a first plane and a lower most edge extending in a second plane; and first and second lateral attachment supports adjacent first and second portions of the outer surface, respectively, wherein the first and second lateral attachment supports of the hip support are located above the second plane and wherein the first and second attachment supports cooperate with the left and right attachment points to pivotally support the frame on the hip support about first and second axes substantially perpendicular to the first and second portions of the outer surface, respectively.

* * * * *